US006868759B2

(12) United States Patent
Tuan-Mu

(10) Patent No.: US 6,868,759 B2
(45) Date of Patent: Mar. 22, 2005

(54) REVERSIBLE RATCHETING TOOL

(75) Inventor: Hsien-Chung Tuan-Mu, Taichung (TW)

(73) Assignee: Easco Hand Tools Inc., Simsbury, CT (US)

( * ) Notice: Subject to any disclaimer, the term of this patent is extended or adjusted under 35 U.S.C. 154(b) by 22 days.

(21) Appl. No.: 10/644,942

(22) Filed: Aug. 19, 2003

(65) Prior Publication Data

US 2004/0035257 A1 Feb. 26, 2004

Related U.S. Application Data

(60) Provisional application No. 60/404,971, filed on Aug. 20, 2002.

(51) Int. Cl.[7] ..... B25B 13/46
(52) U.S. Cl. ..... 81/63.2; 81/63
(58) Field of Search ..... 81/60, 61, 62, 81/63, 63.1, 63.2

(56) References Cited

U.S. PATENT DOCUMENTS

| | | | | |
|---|---|---|---|---|
| 858,894 | A | 7/1907 | Moss | |
| 1,413,243 | A | 4/1922 | Thompson | 81/63.1 |
| 1,957,462 | A | 5/1934 | Kress | 81/63 |
| 2,193,984 | A | 3/1940 | Rhinevault | 192/43.2 |
| 2,570,779 | A | 10/1951 | Dodge et al. | 81/62 |
| 2,701,977 | A | 2/1955 | Stone | 81/63.2 |
| 3,250,157 | A | 5/1966 | Badger | 81/63 |
| 3,393,780 | A | 7/1968 | Kilness | 192/43.2 |
| 3,575,069 | A | 4/1971 | White | 81/58.1 |
| 3,866,492 | A | 2/1975 | Knoll | 81/52.4 |
| 4,328,720 | A | 5/1982 | Shiel | 81/63 |
| 4,336,728 | A | 6/1982 | Deibert | 81/62 |
| 4,491,043 | A | 1/1985 | Dempsey et al. | 81/58 |
| 4,515,044 | A | 5/1985 | Harstad | 81/61 |
| 4,553,453 | A | 11/1985 | Dempsey et al. | 81/58 |
| 4,991,468 | A | 2/1991 | Lee | 81/60 |
| 4,993,288 | A | 2/1991 | Anderson et al. | 81/57.39 |
| 5,140,875 | A | 8/1992 | Kim | 81/63.1 |
| 5,157,994 | A | 10/1992 | Krivec | 81/63.2 |
| 5,178,047 | A | 1/1993 | Arnold et al. | 81/63.2 |
| 5,199,330 | A | 4/1993 | Arnold et al. | 81/63.2 |
| 5,448,931 | A | 9/1995 | Fossella et al. | 81/63.2 |
| 5,533,427 | A | 7/1996 | Chow | 81/63.2 |
| 5,626,062 | A | 5/1997 | Colvin | 81/63.2 |
| 5,636,557 | A | 6/1997 | Ma | 81/60 |
| 5,794,496 | A | 8/1998 | Arnold | 81/63.2 |
| 5,819,606 | A | 10/1998 | Arnold | 81/124.3 |
| 5,857,390 | A | 1/1999 | Whiteford | 81/62 |
| 5,901,620 | A | 5/1999 | Arnold | 81/63.2 |
| 5,927,158 | A | 7/1999 | Lin | 81/60 |
| 5,957,009 | A | 9/1999 | McCann | 81/63.2 |
| 5,964,129 | A | 10/1999 | Shiao | 81/63.2 |
| 6,101,902 | A | 8/2000 | Wei | 81/63 |
| 6,134,990 | A | 10/2000 | Ling et al. | 81/60 |
| 6,164,167 | A | 12/2000 | Chen | 81/63.2 |
| 6,220,123 | B1 | 4/2001 | Chen | 81/63.2 |
| 6,230,591 | B1 | 5/2001 | Ling et al. | 81/63 |
| 6,260,448 | B1 | 7/2001 | Chaconas | 81/63 |
| 6,260,449 | B1 | 7/2001 | I-He | 81/63.2 |
| 6,279,428 | B1 | 8/2001 | Huang | 81/63.1 |
| 6,431,030 | B1 | 8/2002 | Kuo et al. | 81/63 |
| 6,431,031 | B1 | 8/2002 | Hu | 81/63.2 |
| 6,435,063 | B1 | 8/2002 | Chen | 81/63.2 |
| 6,457,388 | B1 | 10/2002 | Chen | 81/63.2 |
| 6,715,382 | B1 * | 4/2004 | Hsien | 81/63.2 |
| 6,761,091 | B2 * | 7/2004 | Hsien | 81/63.2 |
| 2002/0166417 | A1 | 11/2002 | Hu | 81/63.2 |
| 2003/0070512 | A1 | 4/2003 | Hu | 81/63.2 |

FOREIGN PATENT DOCUMENTS

| | | |
|---|---|---|
| TW | 488342 | 5/2002 |

* cited by examiner

*Primary Examiner*—Jacob K. Ackun, Jr.
(74) *Attorney, Agent, or Firm*—Nelson Mullins Riley & Scarborough, L.L.P.

(57) ABSTRACT

A ratcheting tool has a head and a handle attached to the head. The head rotatably receives a gear ring and receives a pawl that is in operative engagement with the gear ring. A housing disposed in the head receives a spring that is in operative engagement with the pawl so that rotation of a lever causes the pawl to move between a first position and a second position.

43 Claims, 13 Drawing Sheets

REVERSIBLE RATCHETING TOOL

CROSS REFERENCE TO RELATED APPLICATION

The present application claims the benefit of U.S. Provisional Patent Application No. 60/404,971, filed Aug. 20, 2002, the entire disclosure of which is incorporated by reference herein.

BACKGROUND OF THE INVENTION

Ratcheting tools, for example ratchets and wrenches, often include a circular ratchet gear and a pawl that controls the gear's ratcheting direction so that the gear may rotate in one direction but is prevented from rotation in the other. It is known to dispose the pawl so that it engages teeth either on the gear's inner or outer diameter. Examples of ratcheting tools having a sliding pawl engaging the outer diameter of a ratchet gear are provided in U.S. Pat. Nos. 6,230,591 and 5,636,557, the entire disclosure of each of which is incorporated by reference herein.

SUMMARY OF THE INVENTION

The present invention recognizes and addresses considerations of prior art constructions and methods.

In an embodiment of the present invention, a ratcheting tool has a body defining a head and handle attached to the head. The head defines a first compartment and a second compartment that opens into the first compartment. A gear ring is rotatably disposed in the first compartment and defines a plurality of teeth on an outer circumference thereof. The edges of the teeth extend between opposite axial ends of the gear and may be straight or define a curve extending inward from the opposite axial ends so that an outer surface of the gear is concave at a center area. A pawl disposed in the second compartment defines a plurality of teeth that extend between a top and bottom of the pawl. The teeth may be straight or define curves extending away from the opposite sides so that the pawl face is convex at a center area. A housing disposed in the head receives a spring in operative engagement with the pawl so that rotation of the lever causes the pawl to move between a first position and a second position.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1:
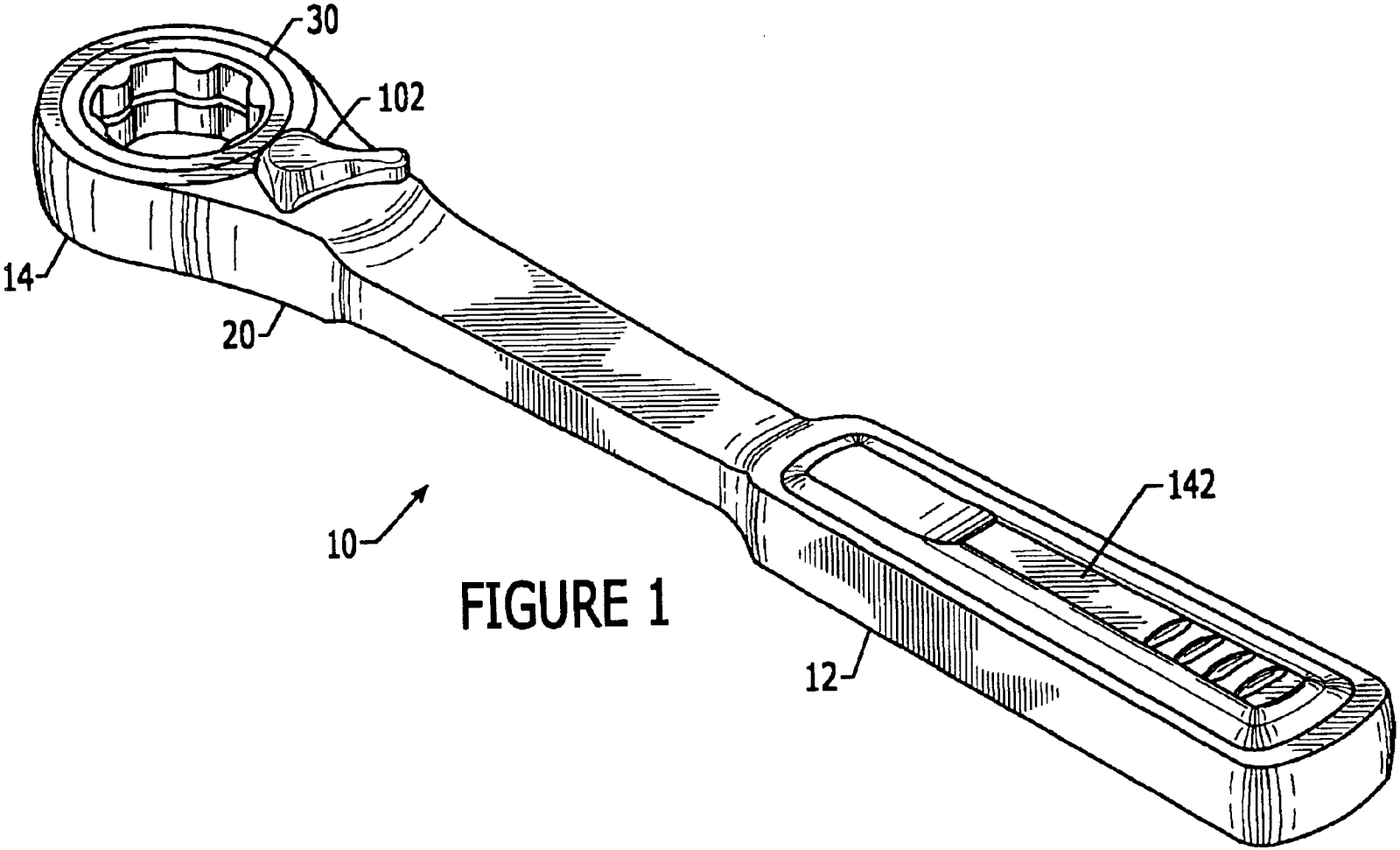
FIG. 1 is a perspective view of an embodiment of a ratcheting tool in accordance with the present invention.
Figure 2:
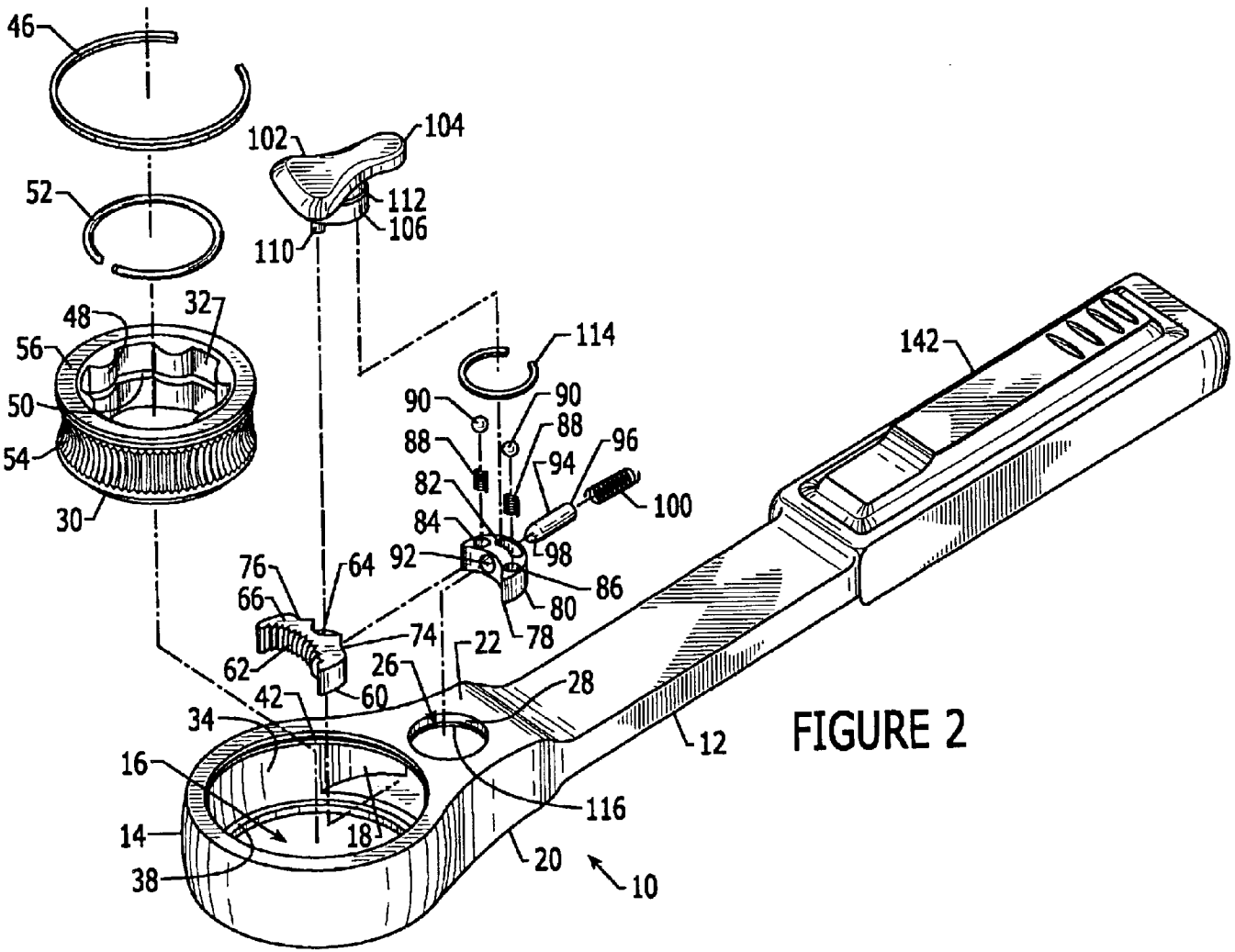
FIG. 2 is an exploded view of the ratcheting tool as in FIG. 1.
Figure 3A:
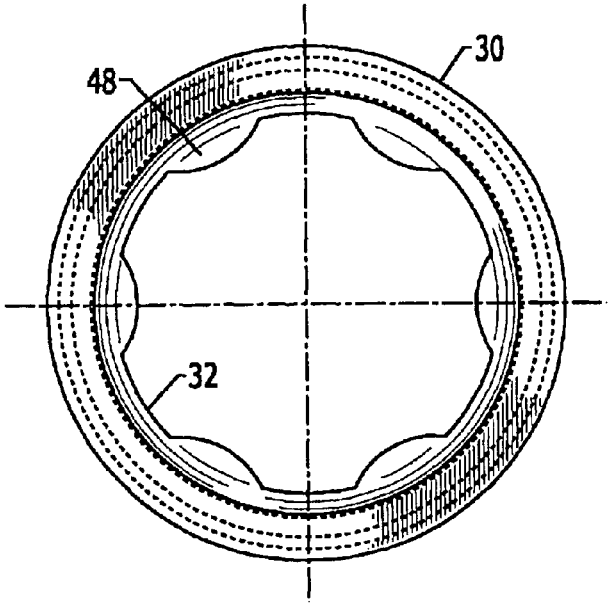
FIG. 3A is a top view of a gear ring for use in the ratcheting tool shown in FIG. 1.
Figure 3B:
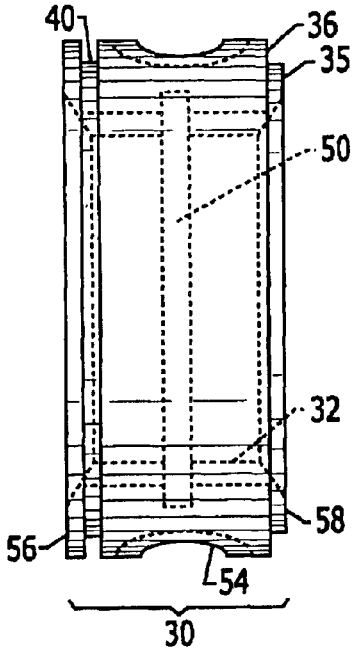
FIG. 3B is a side view of the gear ring shown in FIG. 3A.
Figure 4:
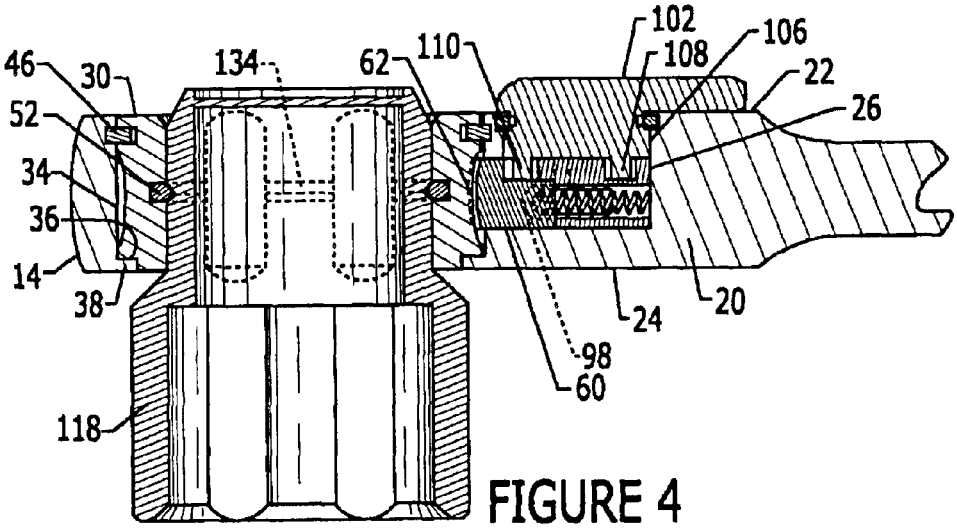
FIG. 4 is a partial sectional view of the ratcheting tool shown in FIG. 1 including a socket.

Referring to FIGS. 1–10, and in particular to FIGS. 1–4, a ratcheting tool 10 includes an elongated arm that may be formed as a handle 12. Handle 12 may be a solid piece or may include snap-in polymer inserts 142, one of which is shown in FIGS. 1 and 2. A head 14 extends from the handle 12, and the head and handle may be integrally formed from the same material. The head has three openings formed therein (FIG. 2). The first is a substantially cylindrical opening 16 distal from handle 12. A second opening 18 opens into cylindrical opening 16 and is intermediate the first opening and a third opening 26 located in a web 20. Compartment 18 is closed above and below by top and bottom faces 22 and 24 of web 20 (FIG. 4). Third opening 26, located proximate to handle 12, is substantially cylindrical, extends through face 22 into web 20 at a hole 28 and opens into second opening 18.

FIGS. 2, 3A and 3B disclose an annular gear ring 30 having a plurality of equi-spaced teeth 54 that are formed about the gear ring's outer circumference. The teeth curve inward at their center so that the gear ring's outer surface defines a concave shape. The gear ring is received in cylindrical opening 16 and includes an inner surface 32 that is concentric with an inner surface 34 of head 14. A bottom side of gear ring 30 defines an extension portion 35 surrounded by a flat annular shoulder 36. Extension portion 35 fits through a ledge 38 extending radially inward from inner surface 34 of head 14 so that shoulder 36 sits on ledge 38 (FIG. 4), thereby retaining gear ring 30 in the lower axial direction. Extension portion 35 fits through ledge 38 with sufficient clearance so that the ledge secures the gear ring in the radial direction yet permits the gear ring to rotate with respect to head 14.

Gear ring 30 defines an annular groove 40 (FIG. 3B) about its outer surface proximate its upper end. Referring to FIG. 4, groove 40 receives a C-ring 46 wherein an outer surface of the C-ring normally extends slightly outward of the groove. As gear ring 30 is inserted into compartment 16, C-ring 46 compresses into groove 40 until groove 40 aligns with an annular groove 42 extending into the upper edge of the tool head's inner surface 34. C-ring 46 then expands into groove 42, thereby securing gear ring 30 in the upper axial direction.

Referring again to FIGS. 3A and 3B, inner surface 32 of gear ring 30 defines six vertically-aligned keys 48 spaced equiangularly about inner surface 32. Keys 48 extend radially into compartment 16 (FIGS. 5A–5C) and have surfaces that are arcuate in cross-section. The arcuate surfaces are defined by circles intersecting what would otherwise be the circular boundary of surface 32. Inner surface 32 defines a groove 50 extending entirely about surface 32 approximately half way between the top and bottom sides of gear ring 30. While the mid-point of surface 32 is preferred, groove 50 may be defined at any suitable position. Referring again to FIG. 4, groove 50 receives a C-ring 52, and an inner surface of C-ring 52 normally extends radially inward of the inner diameter of surface 32. Thus, a portion of C-ring 52 extends into compartment 16 between keys 48. Additionally, a portion of the top and bottom surface of gear ring 30 is beveled between inner surface 32 and a top and bottom flat surface 56 and 58.

Figure 5A:
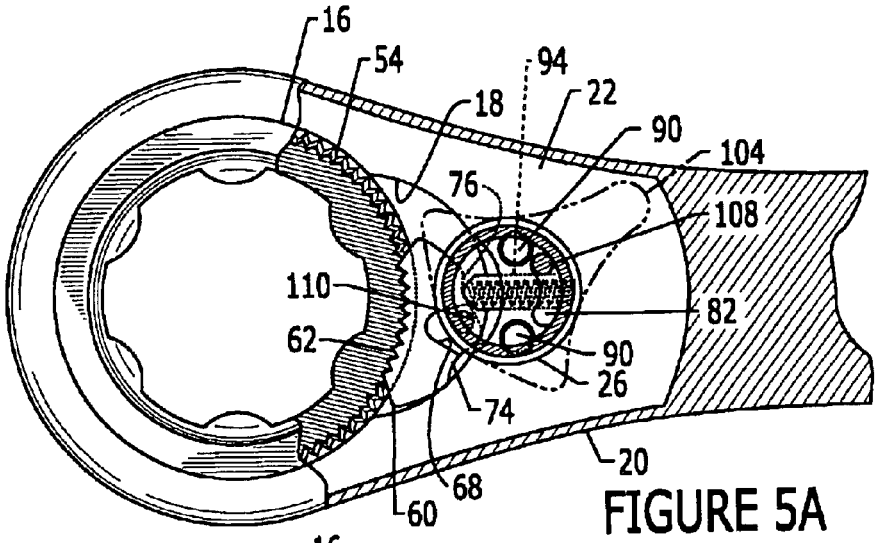
FIG. 5A is a top plan view of the ratcheting tool of FIG. 1, partly in section, with the reversing lever moved to a first predetermined position.
Figure 5B:
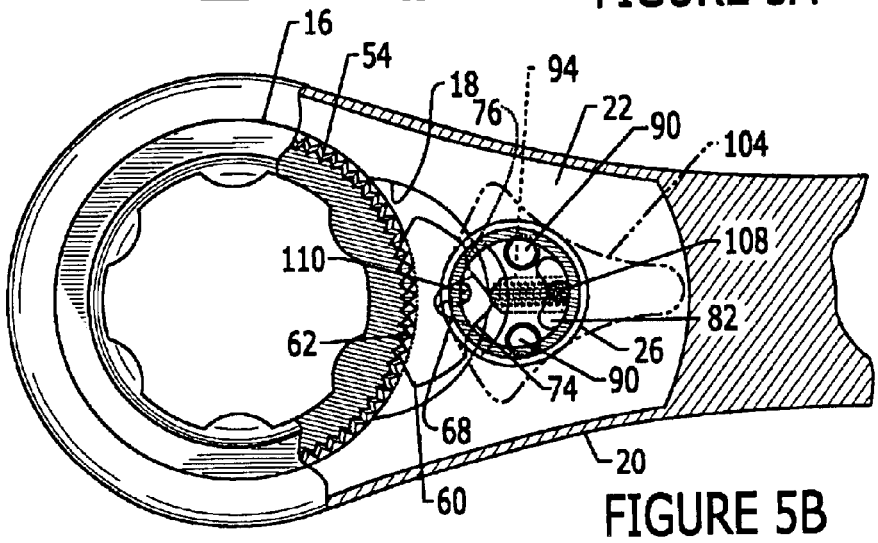
FIG. 5B is a top plan view of the ratchet tool of FIG. 1, partly in section, with the reversing lever rotated in the clockwise direction from its position shown in FIG. 5A.
Figure 5C:
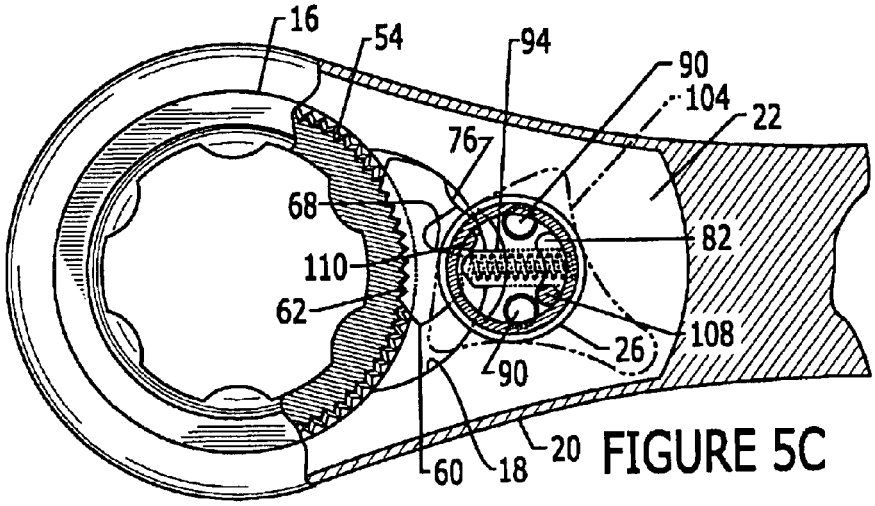
FIG. 5C is a top plan view of the ratcheting tool of FIG. 1, partly in section, with the reversing lever moved to a second predetermined position.

As shown in FIGS. 2 and 4, compartment 18 receives a generally wedge-shaped pawl 60 so that the top and bottom surfaces of compartment 18 retain the pawl from above and below. Sufficient clearance is provided between those surfaces and the pawl, however, so that the pawl may easily slide from side to side. Pawl 60 defines a plurality of vertically-aligned teeth 62 aligned in an arc across the pawl's front face that matches the arc of the outer perimeter of gear ring 30. In the vertical direction, teeth 62 are convex shaped to correspond to the concave outer surface of gear ring 30. Consequently, when the pawl engages the gear ring, as shown in FIGS. 5A and 5C, all of teeth 62 engage opposing teeth 54 on the gear ring.

Figure 6:
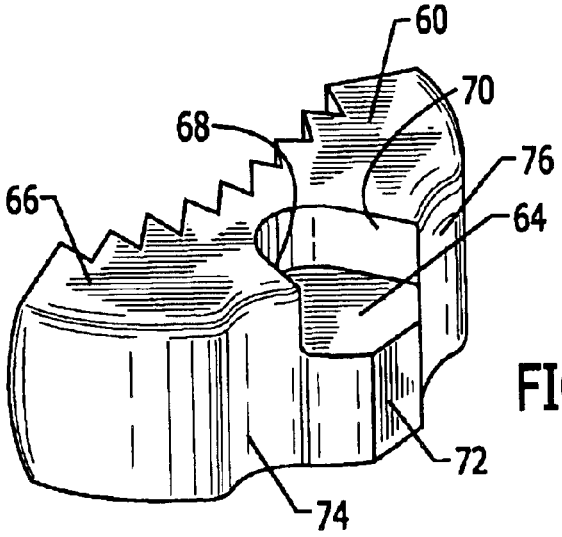
FIG. 6 is a perspective view of a pawl for use in the ratcheting tool shown in FIG. 1.

Referring to FIG. 6, a notch 64 extends downward into the back end of pawl 60 from a top surface 66. Notch 64 defines symmetric sides 68 and 70 that extend outward from front to back at an acute angle with respect to the pawl's center line. Notch 64 sits atop a ridge 72 extending from the back of the pawl. Ridge 72 is defined by a pair of grooves 74 and 76 on either side of the ridge that extend into the pawl's otherwise convex back surface.

Figure 7:
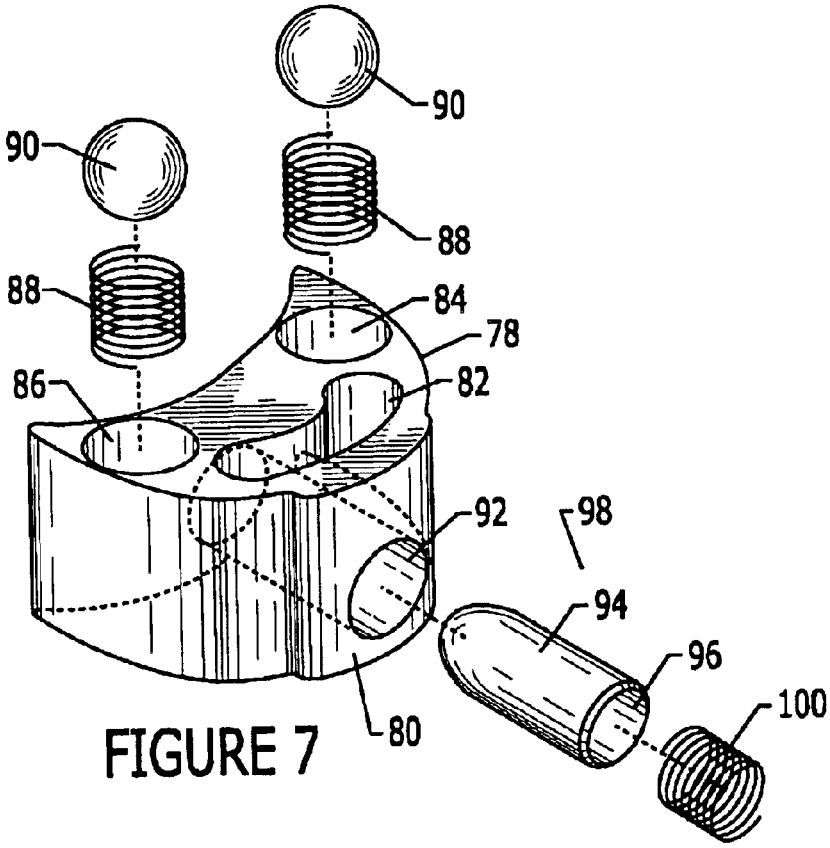
FIG. 7 is a perspective view of a lever housing for use in the ratcheting tool shown in FIG. 1.

Referring to FIGS. 2 and 7, compartment 26 receives a wedge-shaped housing 78 having a generally arcuate back surface that matches the surface of compartment 26. The back end of housing 78 defines an outwardly-extending notch 80 that fits into a corresponding groove (not shown) in the back of compartment 26 to retain the housing in position. An arcuate groove 82, and two cylindrical bores 84 and 86, extend downward into the housing from the housing's top surface. Groove 82 and bores 84 and 86 are blind; they do not extend entirely through the housing. Each of bores 84 and 86 receive a spring 88 and a ball 90.

A bore 92 extends entirely through housing 78 from back to front and receives a cylindrical pin 94. An axial bore 96 extends from the back of pin 94 to proximate the pin's curved front end 98. A spring 100 received in bore 96 engages the back end of compartment 26 and biases the pin forward (FIGS. 5A–5C).

Figure 8A:
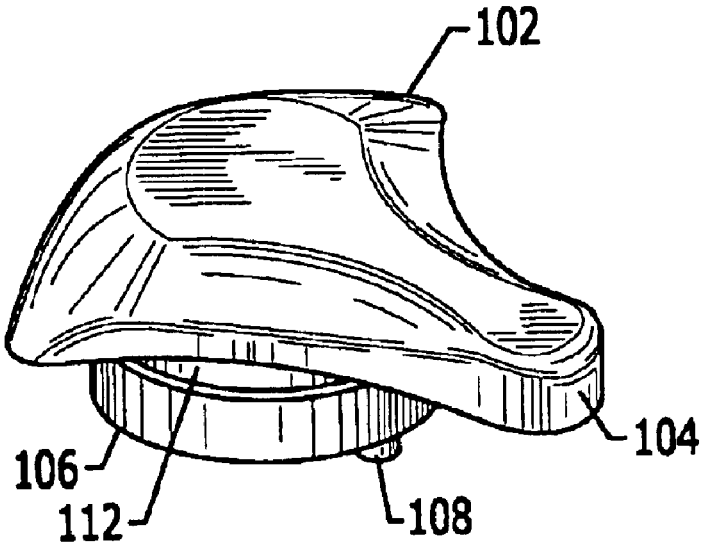
FIG. 8A is a perspective view of a lever for use in the ratcheting tool shown in FIG. 1.
Figure 8B:
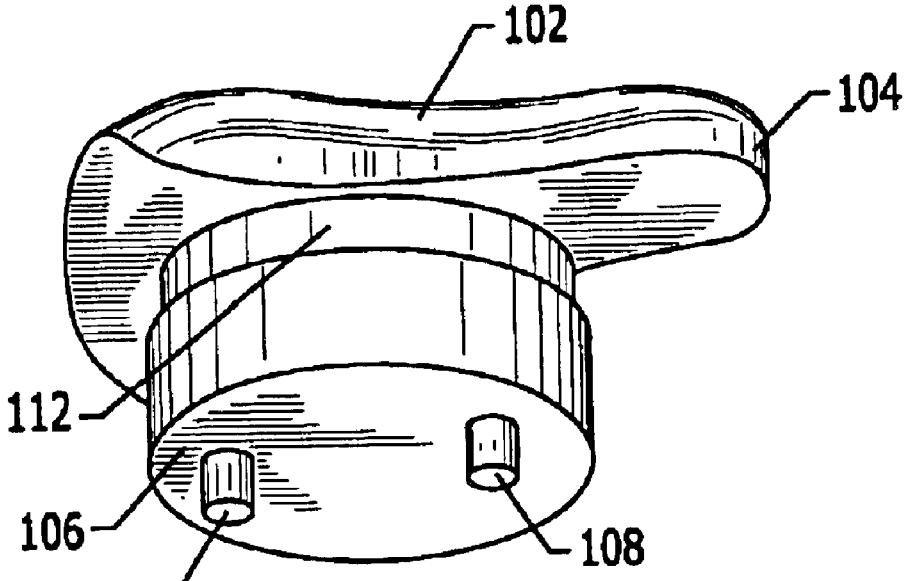
FIG. 8B is a bottom perspective view of the lever shown in FIG. 8A.

Referring to FIGS. 2, 8A and 8B, a switch lever 102 includes a handle portion 104 and a cylindrical bottom portion 106 extending below the handle portion. A pair of pins 108 and 110 extend downward from extension 106. The outer surface of extension 106 defines an annular groove 112 that receives a C-ring 114 that normally extends slightly outward of groove 112.

Referring again to FIGS. 2 and 4, hole 28 defined in top surface 22 of web 20 receives extension 106. The outer diameter of extension 106 is approximately equal to the inner diameter of hole 28, although sufficient clearance is provided so that switch lever 102 rotates easily in the hole. Upon insertion of extension 106 into hole 28, C-ring 114 is initially pushed radially inward into groove 112. When groove 112 aligns with an annular groove 116 defined about the inner circumference of hole 28, an outer portion of C-ring 114 extends into groove 116, thereby axially securing switch lever 102 in web 20.

When switch lever 102 is inserted into hole 28, pin 110 extends into notch 64 of pawl 60, and pin 108 extends into arcuate groove 82 of housing 78. Springs 88 bias their respective balls 90 upward against the bottom surface of extension 106 of switch lever 102, thereby pushing the switch up against C-ring 114. This prevents the switch lever from sitting loosely in hole 28 and facilitates the switch lever's smooth rotation.

Figure 9A:
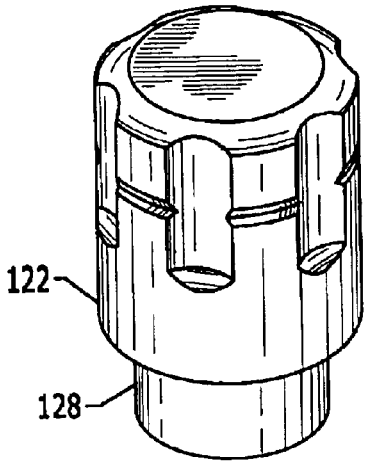
FIGS. 9A–9B are perspective views of rotary tools for use with the ratcheting tool shown in FIG. 1.
Figure 9B:
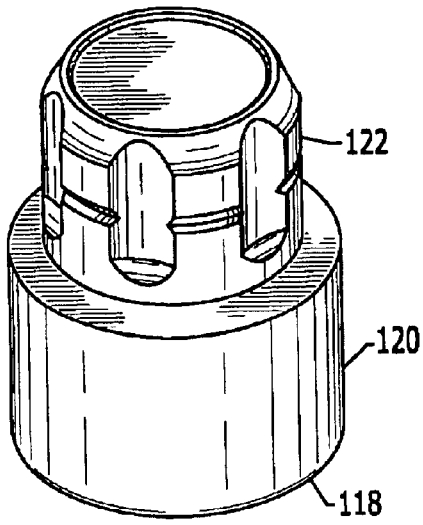
Figure 10A:
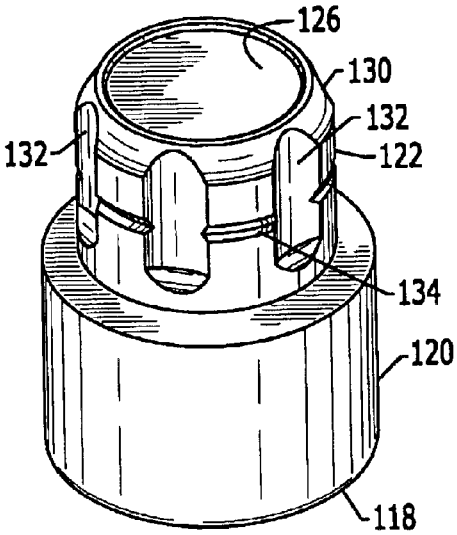
FIGS. 10A–10E provide details of the rotary tool shown in FIG. 9B.
Figure 10B:
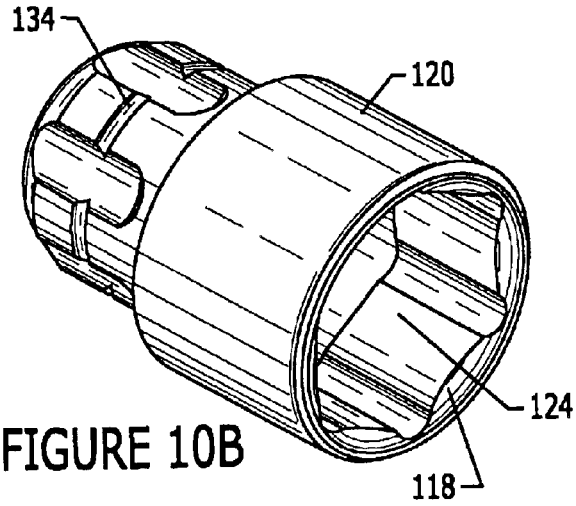
Figure 10C:
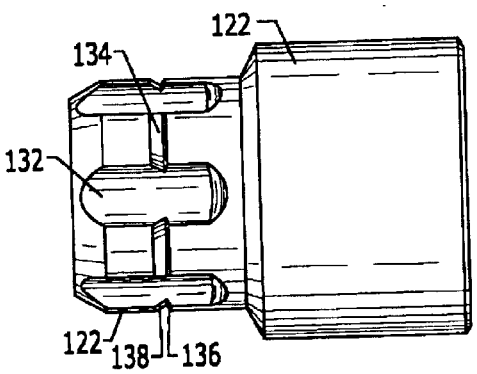
Figure 10D:
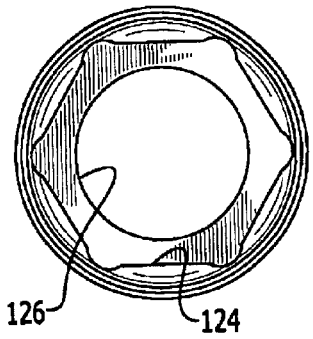
Figure 10E:
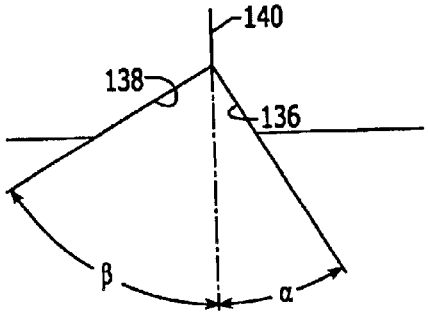
Figure 11B:
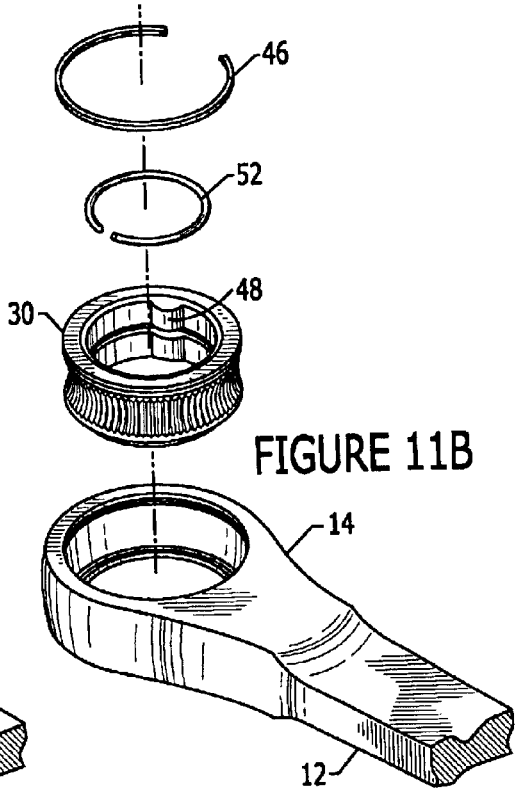
FIGS. 11A–11D are perspective views of an embodiment of a ratcheting tool in accordance with an embodiment of the present invention.
Figure 11A:
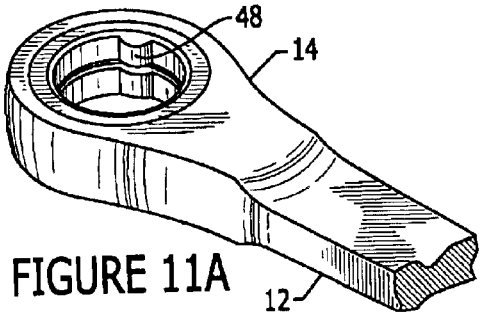
Figure 11C:
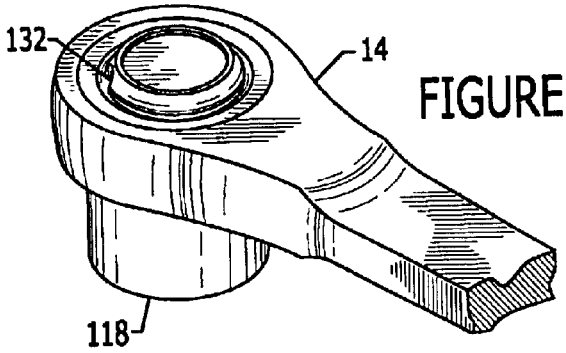
Figure 11D:
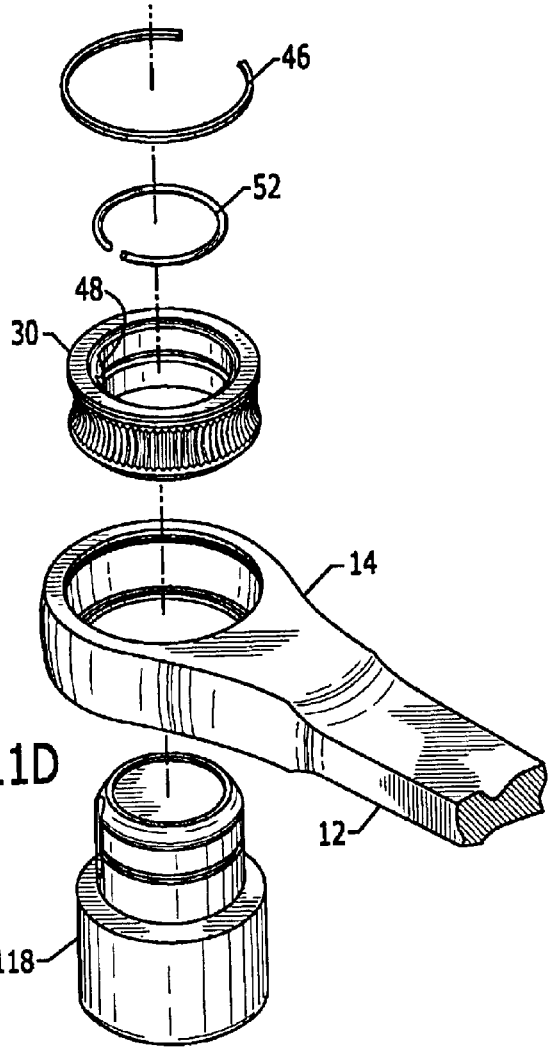
Figure 12A:
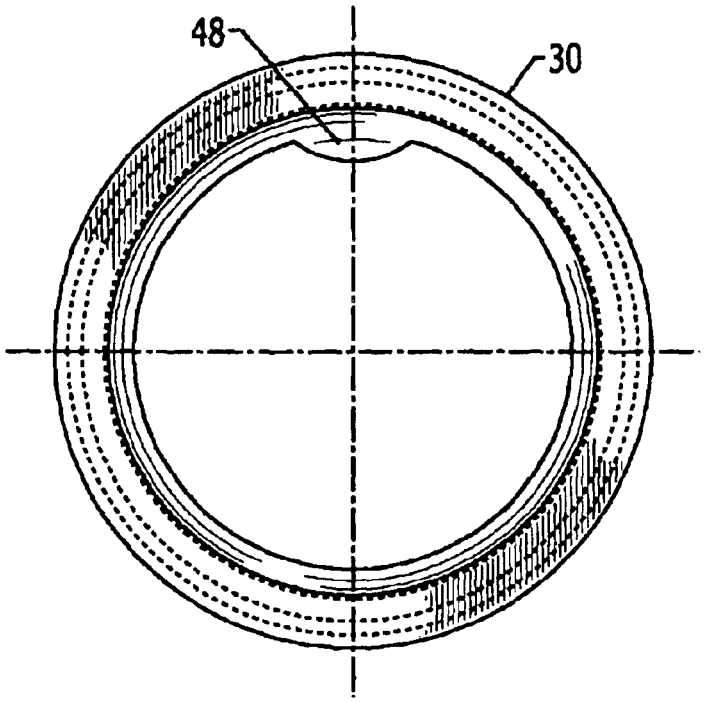
FIGS. 12A–12B are top and side views of a gear ring for use in the ratcheting tool shown in FIGS. 11A–11D.
Figure 12B:
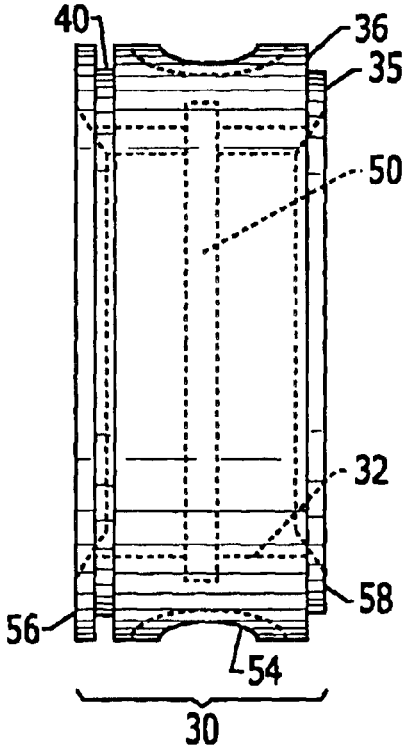
Figure 13A:
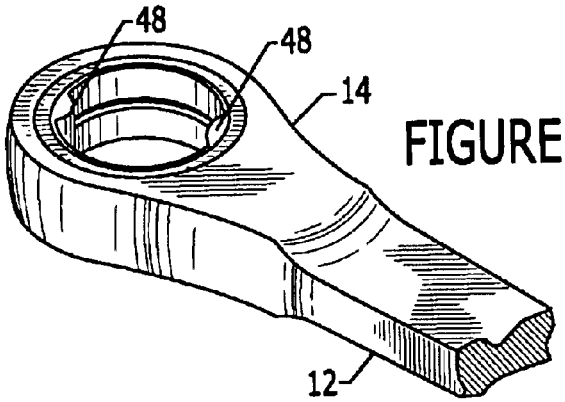
FIGS. 13A–13D are perspective views of an embodiment of a ratcheting tool in accordance with an embodiment of the present invention.
Figure 13B:
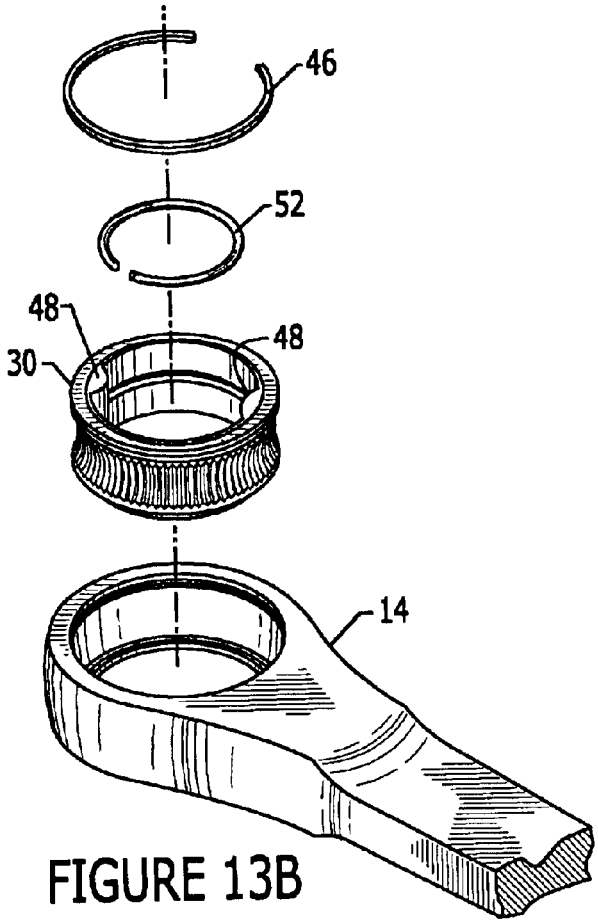
Figure 13C:
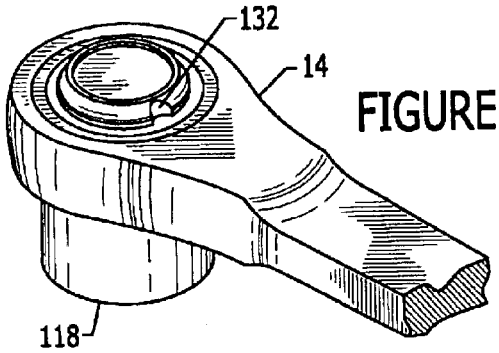
Figure 13D:
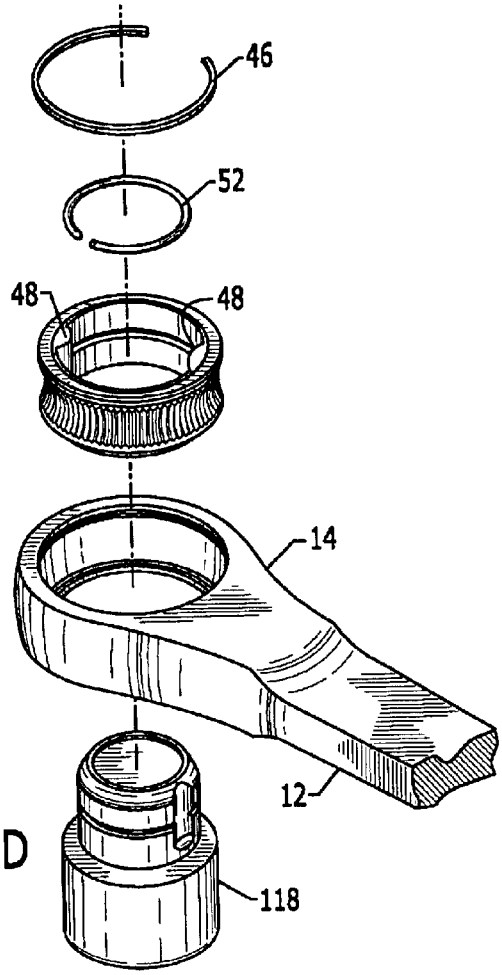
Figure 14A:
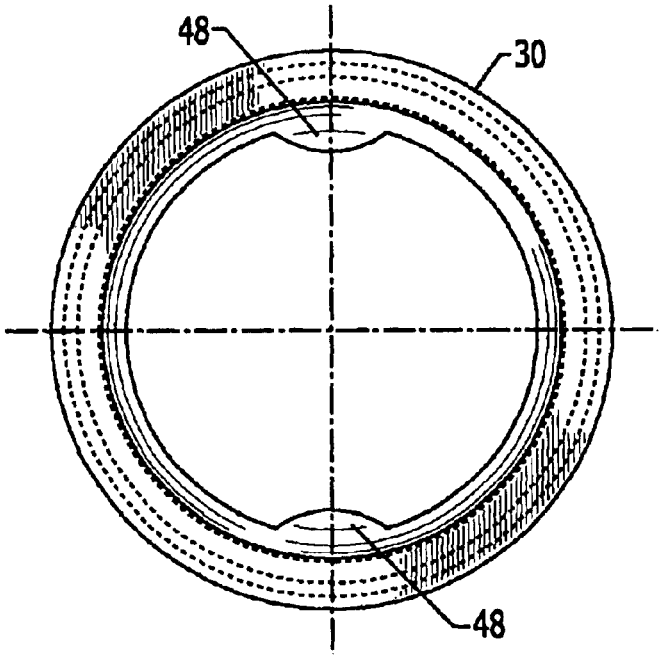
FIGS. 14A–14B are top and side views of a gear ring for use in the ratcheting tool shown in FIGS. 13A–13D Repeat use of reference characters in the present specification and drawings is intended to represent same or analogous features or elements of the invention.
Figure 14B:
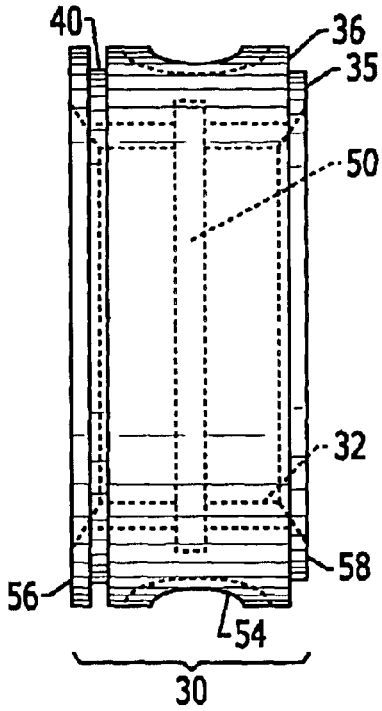

FIGS. 9A and 9B show two work tools 118 for use with ratcheting tool 10. The work tool generally includes a post portion 122 and may include a socket portion 120 (FIG. 9B) or any desired tool end, for example a screwdriver head or an extension post 128 (FIG. 9A). Referring specifically to FIGS. 10A–10E, a socket 118 includes a socket portion 120 and a post portion 122. Socket portion 120 may define an inner surface 124 of any suitable socket shape, for example TORX, hex, or double hex configuration, as should be well understood. The socket's inner bore may extend in a countersunk manner entirely through the socket, as shown in FIGS. 10A and 10D at 126, or may end in a blind surface at post section 122. Thus, while a socket 118 is discussed herein, it should be understood that this is for purposes of example only and that the present invention may be employed with any suitable tool head that an operator desires to rotationally drive in ratcheting tool 10. For purposes of the present discussion, such a tool head may be referred to as a "rotary tool."

Post 122 is beveled at an upper surface 130 to facilitate its insertion into the center hole of gear ring 30. Referring also to FIGS. 2 and 4, the post's sides define six equiangularly spaced keyways 132 shaped correspondingly to keys 48 of gear ring 30 so that keys 48 secure socket 118 from rotating with respect to the gear ring.

The outer surface of post 122 defines an annular groove 134 that aligns with groove 50 when the post is inserted into the gear ring so that C-ring 52 extends into groove 134, thereby securing socket 118 axially in the gear ring. As shown in FIG. 10C, groove 134 has a pair of frustoconical sides 136 and 138 that meet in an apex at the back of the groove. Lower surface 136 defines an angle α (FIG. 10E) with respect to a plane 140 that bisects post 122 through aligned grooves 134 and 50. Upper side 138 defines an angle β (FIG. 10E) that is larger than angle α. The smaller angle α restricts the ability to push socket 118 upward over C-ring 52, while the larger angle β facilitates the socket's removal in the lower direction by a force that may be readily applied by hand. In one preferred embodiment, angle α is 30° and angle β is 60°, although it should be understood that groove 134 may have any suitable configuration.

In operation, ratcheting tool 10 may be used as a ratcheting socket wrench upon the insertion of socket 118 as described above. Alternatively, the inner circumference of gear ring 30 may be sized so that tool 10 may also be used as a ratcheting wrench. In this case, keys 48 may, for example, be used to abut the flat sides of a hexagonal nut or other work piece the operator desires to drive. Thus, it should be understood that tool 10 may be used in either manner and that the tool's operation described below applies equally well to either situation.

When the pawl engages the gear ring on either side of compartment 18, pin 110 extends into notch 64 without engaging either of sides 68 or 70 (FIG. 6). Pin 108 extends into groove 82 in the housing. Groove 82 guides the rotation of switch 102, and its ends provides stops that limit the lever's rotation. Thus, when switch lever 102 is rotated to either of its limits so that pawl 60 is on one of the two lateral sides of compartment 18, pin 108 engages a corresponding side of groove 82, and pin 110 sits in notch 64 between sides 68 and 70.

Referring once again to FIGS. 5A–5C, and as indicated above, pawl 60 may slide to either side of compartment 18. In the position shown in FIG. 5A, pawl 60 is wedged between gear ring 30 and the lower surface of compartment 18. The front curved end 98 of pin 94 is pushed forward by spring 100 (FIG. 2) so that pin 94 engages curved groove 76 in the pawl's back side, thereby biasing the pawl into the wedged position. If torque is applied to handle 12 in the counterclockwise direction, the sides of compartment 18 push teeth 62 of pawl 60 upward against the sides of teeth 54 of gear ring 30. If gear ring 30 is secured to a work piece, the reaction force applied to pawl 60 pushes the pawl against the side of compartment 18. That is, the pawl remains wedged between the gear ring and the compartment's bottom edge, and the force applied from the operator's hand to the pawl through the bottom side of compartment 18 is therefore applied in the counterclockwise direction to the work piece through gear ring 30.

If an operator applies torque to the handle in the clockwise direction, teeth 54 of gear ring 30 apply a counterclockwise reaction force to pawl 60. If gear ring 30 and/or socket 118 remains rotationally fixed to a work piece, teeth 54 hold the pawl in position so that the pawl moves back and up into compartment 18, causing the curved side of groove 76 to push against the rounded tip of pin 94. This pushes pin 94 against the force of spring 100, and pawl teeth 62 eventually ride over gear teeth 54. Spring 100 then pushes pin 94 forward against the sloped surface of groove 76, forcing pawl 60 back down toward the bottom face of compartment 18 and into the next set of gear ring teeth. This ratcheting process repeats as the operator continues to rotate handle 12.

To change the operative direction of ratcheting tool 10, the operator rotates switch 102 in the clockwise direction (as shown in FIG. 5B). Referring also to FIGS. 2, 4 and 6, extension 106 rotates in hole 28, and pin 108 moves through arcuate groove 82, thereby bringing pin 110 into contact with side 70 of notch 64. Continued rotation of switch 102 applies a counterclockwise force to the pawl so that pawl teeth 62 ride up and back into compartment 18 on gear teeth 54. Gear ring 30 may also rotate slightly. This pushes pin 94 back against the force of spring 100. As the operator continues to rotate switch 102 toward the position shown in FIG. 5C, ridge 72 passes over the end of pin 94. Pin 94 then pushes forward against the curved surface of the following groove 74 in the back of the pawl. This assists the desired movement of the pawl, which then moves upward in compartment 18 and wedges between the gear ring and the compartment's upper edge, as shown in FIG. 5C. When the pawl has moved over to this wedged position, the configuration and operation of the gear, pawl and switch mirrors that described above. Thus, the tool ratchets, and applies torque to a work piece, in the same manner but in opposite directions.

It should also be understood that various configurations of the components described herein may be employed. For example, while six keys 48 are illustrated in the embodiment shown in FIGS. 2 and 5, it should be understood that the gear ring and socket may define any suitable number of keys 48 and corresponding keyways 132 (FIG. 10A). For example, the embodiments shown in FIGS. 11A–12B and FIGS. 13A–14B (other components of the tool have been eliminated for purposes of clarity) illustrate single and dual key/keyway combinations, respectively.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed:

1. A ratcheting tool comprising:

a handle;

a head extending from the handle and having a first compartment, a second compartment that opens to the first compartment, and a third compartment that opens to the second compartment;

a gear ring rotatably disposed in the first compartment and defining a plurality of first teeth about an outer circumference thereof;

a pawl disposed in the second compartment and having a front side that faces the first teeth of the gear ring and that has a plurality of second teeth, and a back side facing away from the gear ring, wherein the pawl is movable within the second compartment between a first position in which the first teeth and second teeth are engaged on one side of the second compartment and a second position in which the first teeth are engaged on an opposite side of the second compartment;

a housing disposed in the third compartment;

a spring received by the housing and in biasing engagement with the back side of the pawl so that the spring biases the second teeth of the pawl into meshing engagement with the first teeth of the gear ring when the pawl is in either the first position or the second position and so that the pawl is movable against the bias of the spring when the handle is rotated in a ratcheting direction with respect to the gear ring; and a lever having a hand actuatable outer portion and an inner portion extending into the head in driving engagement with the pawl, wherein the lever is disposed movably with respect to the head and with respect to the housing so that a movement of the hand actuatable portion with respect to the head and the housing moves the inner portion to drive the pawl from one of the first position and the second position toward the other of the first position and the second position against the bias of the spring.

2. The ratcheting tool as in claim 1, wherein the housing is disposed in a fixed position with respect to the head.

3. The ratcheting tool as in claim 1, wherein the lever is disposed rotatably in the head.

4. The ratcheting tool as in claim 3, wherein the head defines a hole that opens to the second compartment, and wherein the lever is rotatably disposed in the hole.

5. The ratcheting tool as in claim 3, wherein the inner portion of the lever includes a pin that extends between opposing surfaces of the pawl so that a rotation of the lever causes the pin to engage one of the opposing surfaces to thereby drive the pawl from one of the first position and the second position toward the other of the first position and the second position.

6. The ratcheting tool as in claim 1, including a pin received by the housing between the spring and the back side of the pawl so that the spring biases the pawl through the pin.

7. The ratcheting tool as in claim 1, wherein the back side of the pawl defines two grooves separated by a ridge, and wherein the spring biasingly engages one of the grooves when the pawl is in the first position and biasingly engages the other of the grooves when the pawl is in the second position.

8. A ratcheting tool comprising:

a handle;

a head extending from the handle and having a first compartment, a second compartment that opens to the first compartment, and a third compartment that opens to the second compartment;

a gear ring rotatably disposed in the first compartment and defining a plurality of first teeth about an outer circumference thereof;

a pawl disposed in the second compartment and having a front side that faces the first teeth of the gear ring and that has a plurality of second teeth, and a back side facing away from the gear ring, wherein the pawl is slidable within the second compartment between a first position in which the pawl is wedged between the gear ring and a first side surface of the second compartment and a second position in which the pawl is wedged between the gear ring and a second side surface of the second compartment;

a housing disposed in the third compartment;

a first spring received by the housing and in biasing engagement with the back side of the pawl so that the first spring biases the second teeth of the pawl into meshing engagement with the first teeth of the gear ring when the pawl is in either the first position or the second position and so that the pawl is movable against the bias of the first spring when the handle is rotated in a ratcheting direction with respect to the gear ring; and a lever having a hand actuatable outer portion and an inner portion extending into the head in driving engagement with the pawl, wherein the lever is disposed in the head movably with respect to the head and with respect to the housing so that a movement of the hand actuatable portion with respect to the head and the housing moves the inner portion to drive the pawl from one of the first position and the second position toward the other of the first position and the second position against the bias of the first spring.

9. The ratcheting tool as in claim 8, wherein the housing is disposed in a fixed position with respect to the head.

10. The ratcheting tool as in claim 8, wherein the lever is disposed rotatably in the head.

11. The ratcheting tool as in claim 10, wherein the head defines a hole that opens to the second compartment, and wherein the lever is rotatably disposed in the hole.

12. The ratcheting tool as in claim 10, wherein the housing defines an arcuate groove on a surface thereof that faces the lever, and wherein the inner portion of the lever includes a first pin that is received in the arcuate groove so that the arcuate groove limits rotation of the lever with respect to the housing.

13. The ratcheting tool as in claim 12, wherein the inner portion of the lever includes a second pin that extends between opposing surfaces of the pawl so that a rotation of the lever causes the second pin to engage one of the opposing surfaces to thereby drive the pawl from one of the first position and the second position toward the other of the first position and the second position.

14. The ratcheting tool as in claim 8, including a pin received by the housing between the first spring and the back side of the pawl so that the first spring biases the pawl through the pin.

15. The ratcheting tool as in claim 8, wherein the back side of the pawl defines two grooves separated by a ridge, and wherein the first spring biasingly engages one of the grooves when the pawl is in the first position and biasingly engages the other of the grooves when the pawl is in the second position.

16. The ratcheting tool as in claim 8, wherein a surface of the housing that faces the lever defines at least one bore in which a second spring is disposed in engagement with the lever so that the second spring biases the lever against the head.

17. The ratcheting tool as in claim 8, wherein an inner circumference of the gear ring defines a plurality of equiangularly spaced keys.

18. The ratcheting tool as in claim 17, further comprising a tool receivable within the gear ring so that the gear ring applies torque from the handle to the tool through the gear ring, wherein the tool has a tool head and a post attached to the tool head, and wherein an outer surface of the post defines a plurality of equiangularly spaced keyways that receive the keys of the gear ring to thereby hold the post rotationally with respect to the gear ring.

19. The ratcheting tool as in claim 18, wherein the inner circumference of the gear ring further defines a first annular groove, and wherein the outer surface of the post defines a second annular groove that aligns with the first annular groove when the post is received by the gear ring, and further comprising a retaining ring received by the first groove and the second groove to axially retain the post in the gear ring.

20. The ratcheting tool as in claim 8, wherein an inner circumference of the gear ring defines at least one key, and further comprising a tool receivable within the gear ring so that the gear ring applies torque from the handle to the tool through the gear ring, wherein the tool has a tool head and a post attached to the tool head, and wherein an outer surface of the post defines at least one keyway that receives the at least one key of the gear ring to thereby hold the post rotationally with respect to the gear ring.

21. A ratcheting tool comprising:

a handle;

a head extending from the handle and having a first compartment, a second compartment that opens to the first compartment, and a third compartment that opens to the second compartment;

a gear ring rotatably disposed in the first compartment and defining a plurality of first teeth about an outer circumference thereof;

a pawl disposed in the second compartment and having a front side that faces the first teeth of the gear ring and that has a plurality of second teeth, and a back side facing away from the gear ring and defining two grooves separated by a ridge, wherein the pawl is slidable within the second compartment between a first position in which the pawl is wedged between the gear ring and a first side surface of the second compartment and a second position in which the pawl is wedged between the gear ring and a second side surface of the second compartment;

a housing disposed in the third compartment in a fixed position with respect to the head;

a spring received by the housing and in biasing engagement with the back side of the pawl so that the spring biases the second teeth of the pawl into meshing engagement with the first teeth of the gear ring when the pawl is in either the first position or the second position and so that the pawl is movable against the bias of the spring when the handle is rotated in a ratcheting direction with respect to the gear ring, wherein the spring biasingly engages one of the grooves when the pawl is in the first position and biasingly engages the other of the grooves when the pawl is in the second position; and a lever having a hand actuatable outer portion and an inner portion extending into the head in driving engagement with the pawl, wherein the lever is disposed in the head rotatably with respect to the head and with respect to the housing so that a rotation of the hand actuatable portion with respect to the head and the housing rotates the inner portion to drive the pawl from one of the first position and the second position toward the other of the first position and the second position against the bias of the spring.

22. The ratcheting tool as in claim 21, including a pin received by the housing between the spring and the back side of the pawl so that the spring biases the pawl through the pin.

23. A work piece for use with a ratcheting tool, said work piece comprising:

a. a tool end; and b. a post end having a groove defined by a first frustoconical side and a second frustoconical side that intersect at an apex, said first frustoconical side defining a first angle with respect to a plane intersecting said apex and being perpendicular to a longitudinal axis of said work piece, said second frustoconical side defining a second angle with respect to said plane, wherein one of said first angle and said second angle is smaller than the other of said first angle and said second angle.

24. The work piece as in claim 23, wherein said first angle is 30 degrees.

25. The work piece as in claim 23, wherein said second angle is 60 degrees.

26. The work piece as in claim 23, said post end further comprising at least one keyway defined on an outer circumference thereof.

27. The work piece as in claim 23, said tool end defining an axial bore therein, wherein said axial bore is polygonally shaped.

28. The work piece as in claim 23, wherein said tool end is a screw driver.

29. The work piece as in claim 23, wherein said tool end is polygonally shaped.

30. The work piece as in claim 26, said post further comprising a plurality of keyways on said outer circumference.

31. The work piece as in claim 30, wherein said keyways are equiangulalarly spaced about said outer circumference.

32. A rotary tool comprising:

a. a handle;

b. a head extending from said handle;

c. a gear ring rotatably disposed in said head and defining a plurality of first teeth about an outer circumference thereof;

d. a pawl disposed in said head and having a plurality of second teeth in operative engagement with said first teeth; and e. a work piece having a tool end; and a post end having a first groove defined by a first frustoconical side and a second frustoconical side that intersect at an apex, said first frustoconical side defining a first angle with respect to a plane intersecting said apex and being perpendicular to a longitudinal axis of said work piece, said second frustoconical side defining a second angle with respect to said plane, wherein one of said first angle and said second angle is smaller than the other of said first angle and said second angle.

33. The rotary tool of clam 32, said gear ring further comprising a. an axial bore formed therein;

b. a second groove formed on a circumference of said axial bore; and c. a detent received in said second groove.

34. The rotary tool of claim 33, wherein said detent is a spring ring.

35. The rotary tool of claim 33, wherein said detent is a C-ring.

36. The rotary tool of claim 33, wherein when said work piece is inserted into said gear ring axial bore so that said first groove aligns with said second groove, said detent releasably secures said work piece in a first direction and axially blocks said work piece from moving in an axially second direction.

37. The rotary tool of claim 36, wherein said first angle is 30 degrees and said second angle is 60 degrees.

38. The rotary tool of claim 33, further comprising:

a. at least one keyway defined on one of an outer circumference of said work piece and said circumference of said gear ring axial bore; and b. at least one key formed on the other of said outer circumference and said circumference of said gear ring axial bore, wherein said at least one keyway aligns with and receives said at least one key.

39. The rotary tool of claim 32, further comprising:

a. a housing disposed in said head;

b. a spring received by said housing and in biasing engagement with said pawl so that said spring biases said second plurality of teeth into meshing engagement with said first plurality of teeth so that said pawl is movable against said bias of said spring when said handle is rotated in a ratcheting direction with respect to said gear ring; and c. a lever having a hand actuatable outer portion, and an inner portion extending into said head in driving engagement with said pawl.

40. The rotary tool of claim 39, wherein said lever is disposed movably with respect to said head and with respect to said housing so that a movement of said hand actuatable portion with respect to said head and said housing moves said lever inner portion to drive said pawl against said spring bias.

41. The rotary tool of claim 39, wherein said housing is disposed in a fixed position with respect to said head.

42. The rotary tool of claim 39, wherein said lever is disposed rotatably in said head.

43. The rotary tool of claim 42, wherein said lever inner portion includes a pin that extends between opposing surfaces of said pawl so that a rotation of said lever causes said pin to engage one of said opposing surfaces to thereby drive said pawl within said head.

* * * * *